US007393622B2

(12) United States Patent
Urata et al.

(10) Patent No.: US 7,393,622 B2
(45) Date of Patent: Jul. 1, 2008

(54) TWO-COMPONENT DEVELOPING AGENT FOR ELECTROPHOTOGRAPHY

(75) Inventors: Yoshinori Urata, Kashihara (JP); Takeshi Katoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 332 days.

(21) Appl. No.: 11/142,681

(22) Filed: Jun. 2, 2005

(65) Prior Publication Data

US 2005/0271966 A1 Dec. 8, 2005

(30) Foreign Application Priority Data

Jun. 2, 2004 (JP) ..... P2004-164896

(51) Int. Cl.
*G03G 9/113* (2006.01)

(52) U.S. Cl. ..... 430/111.35; 430/111.33

(58) Field of Classification Search ..... 430/111.35, 430/111.33

See application file for complete search history.

(56) References Cited

U.S. PATENT DOCUMENTS

| | | | | |
|---|---|---|---|---|
| 6,042,982 | A * | 3/2000 | Hakata | 430/111.35 |
| 6,134,413 | A * | 10/2000 | Asanae et al. | 399/267 |
| 6,136,484 | A * | 10/2000 | Katayama et al. | 430/63 |

FOREIGN PATENT DOCUMENTS

| | | | |
|---|---|---|---|
| JP | 1-105264 | A | 4/1989 |
| JP | 2-43566 | | 2/1990 |
| JP | 3-2766 | A | 1/1991 |
| JP | 03-072372 | | 3/1991 |
| JP | 04-177369 | | 6/1992 |
| JP | 2000-221733 | A | 8/2000 |
| JP | 2000-338710 | A | 12/2000 |
| JP | 2001-92190 | | 4/2001 |
| JP | 2002-287431 | A | 10/2002 |
| JP | 2003-066656 | | 3/2003 |
| JP | 2003-98761 | A | 4/2003 |
| JP | 2003-255591 | | 9/2003 |
| JP | 2003-280288 | | 10/2003 |
| JP | 2004-109159 | | 4/2004 |
| JP | 2004-144777 | | 5/2004 |
| JP | 2004-361929 | | 12/2004 |

* cited by examiner

*Primary Examiner*—John L Goodrow
(74) *Attorney, Agent, or Firm*—Nixon & Vanderhye P.C.

(57) ABSTRACT

A durable two-component developing agent for electrophotography is provided that can not only suppress scattering of a toner into an inside of an apparatus but also obtain a high image density and can stably obtain a high-quality image even in use for a long period of time. The two-component developing agent for electrophotography includes a toner, and a carrier. The carrier contains a core material and a coating layer formed on a surface thereof. The coating layer is a silicone resin coating layer containing dendritic titanium oxide. Therefore, it is possible to not only suppress scattering of the toner but also obtain a sufficient image density and to form a high-quality image without reducing the image density even in use for a long period of time.

5 Claims, No Drawings

TWO-COMPONENT DEVELOPING AGENT FOR ELECTROPHOTOGRAPHY

This application claims priority to JP 2004-164896 filed 2 Jun. 2004, the entire content of which is hereby incorporated by reference.

BACKGROUND OF THE INVENTION

1. Field of the Invention

The present invention relates to a two-component developing agent for electrophotography.

2. Description of the Related Art

An electrophotographic technique applying a Carlson process has widely been used in an image forming method using a developing agent. The image forming adopting the Carlson process is performed by a charging step, an exposing step, a developing step, a transferring step, a fixing step a cleaning step, a charge-removing step and the like. In the charging step, a surface of a photoreceptor is uniformly charged. In the exposing step, an electrostatic latent image is formed on the surface of the photoreceptor by exposing the thus-charged photoreceptor. In the developing step, a visible image is formed by allowing a developing agent such as a toner to adhere to the electrostatic latent image formed on the surface of the photoreceptor. In the transferring step, a toner image is transferred onto a recording material by charging the recording material with a polarity opposite to that of the toner. In the fixing step, the visible image transferred onto the recording material is fixed by applying measures such as heat and pressure. In the cleaning step, the toner left over on the surface of the photoreceptor without having been transferred to the recording material is recovered. In the charge-removing step, the charge on the photoreceptor is removed. By performing these steps, an image forming apparatus making use of an electrophotographic process forms a desired image on the recording material. A developing system based on the electrophotographic technique is roughly divided into a one-component developing system and a two-component developing system.

The one-component developing system is a system in which a layer made only of the toner is formed on a surface of a developing roller, the thus-formed layer is allowed to be disposed adjacent to the surface of the photoreceptor and, then, development is performed.

The two-component developing system is a system in which magnetic particles denoted as a carrier and the toner which have been friction-charged by mixing therewith are formed as a developing agent layer on the surface of the developing roller that holds a magnet inside and, then, the development is performed by allowing the toner to electrostatically adhere to the photoreceptor. Although an apparatus of the two-component developing system is somewhat complicated compared with that of the one-component developing system, since the two-component developing system is easy to set a potential of the toner and excellent in a property of responding to a high-speed operation and stability, the two-component developing system is mainly used in a medium- to high-speed printer. In the two-component developing system, a two-component developing agent constituted by the toner and the carrier is used.

The toner to be used in the two-component developing agent can be obtained by, for example, a crushing method in which a binder resin, an coloring agent, a charge control agent and a wax as an anti-offset agent are melt-kneaded, cooled to be solidified, crushed and, then, classified, or a polymerization method such as a dispersion polymerization method or an emulsion polymerization method. The thus-obtained toner is mixed with the carrier, to thereby prepare the two-component developing agent.

The carrier, which is constituted by particles having magnetism each denoted as a core material, and a resin coating layer to be formed on a surface of the core material, bears a function of stably charging the toner in a developing apparatus and transporting the toner to a developing region. The core material determines an amount of the carrier to adhere to the developing roller which holds the magnet inside in accordance with magnetic properties which the core material itself has. Further, the resin coating layer mainly bears a function of imparting the charge to the toner and determines a state in which the toner adheres to the carrier. In the two-component developing system which develops the electrostatic latent image by making use of an electrostatic attraction, in order to obtain a favorable visible image, it is necessary that a frictional chargeability of the toner to be determined mainly based on a relation with the carrier is favorable. Therefore, designs of the core material of the carrier and the resin coating layer to be formed on the surface of the core material and setting of a coating amount come to be important.

In recent years, a higher speed and a smaller size of each of a copying machine and a printer has been attempted. In order to stably obtain a high-quality image for a long period of time, durability and environmental stability of the developing agent itself has been required.

As for the two-component developing agent which is excellent in both durability and stability, one two-component developing agent in which a coating layer is contained in an amount, based on 100 parts by weight of the core material of the carrier, of from 0.1 to 5.0 parts by weight and the coating layer is an organic resin having a nitrogen-containing compound is proposed (for example, refer to Japanese Unexamined Patent Publication JP-A 4-177369 (1992)).

However, when this developing agent is used in, for example, a copying machine which has realized a smaller size and a higher operation speed, the coating layer of the carrier is peeled off in use over a long period of time, to thereby expose a surface of the core material which is intrinsically weak. As a result, there is a problem in that initial carrier characteristics have been changed to a great extent to cause a deterioration of an image quality.

Further, in recent years, a two-component developing agent which is excellent in durability and stability by adding a metallic oxide such as titanium oxide into a resin of a coating layer of a carrier is proposed (for example, refer to Japanese Unexamined Patent Publication JP-A 2003-66656). However, since this developing agent is characterized by allowing the metallic oxide contained in the resin of the coating layer to have a density gradient, a production process comes to be extremely complicated. Therefore, there is a problem in that it is difficult to perform a mass-production by such technique as described above and, then, a low-priced product cannot be supplied to customers in a consistent manner.

Further, a toner tends to have a small particle size to meet demand of a higher image quality. When a specific surface area of the toner is increased in accordance with a decrease of the particle size, frictional charge comes to be large, to thereby increase an adhering force between toners themselves and between the toner and the carrier. As a result, fluidity of the developing agent is decreased and, then, since the toner is not stably supplied to the photoreceptor, there is a problem in that an image density is decreased. On the other hand, when a stirring force in a developing apparatus is increased for the purpose of enhancing the fluidity of the developing agent, a endurance life of the developing agent is shortened. Further, when a potential of the toner is decreased for the purpose of preventing the image density from being decreased, an adhering force between the toner and the carrier is decreased, to thereby allow the adhering force between the toners themselves to be over the former adhering force. As a result, toners are aggregated with each other and, then, flowed onto the photoreceptor as an aggregated block and, accordingly, although the image density is increased, the image quality is deteriorated and, also, the toner is scattered, to thereby cause a problem in that an inside of the apparatus is contaminated. Under these circumstances, a two-component developing agent which can balance these contradictory properties and exhibit only an advantage is strongly required.

SUMMARY OF THE INVENTION

An object of the invention is to provide a durable two-component developing agent for electrophotography capable of not only suppressing scattering of a toner into an inside of an apparatus but also obtaining a high image density and capable of stably obtaining a high-quality image even in use for a long period of time.

The invention provides a two-component developing agent for electrophotography, comprising:

a toner; and a carrier, the carrier containing a core material and a coating layer formed on a surface thereof, and the coating layer being a silicone resin coating layer containing dendritic titanium oxide.

According to the invention, by using a silicone resin having a low surface energy and a high durability in the carrier coating layer and containing dendritic titanium oxide which is excellent in a charge stability in the silicone resin coating layer. A frictional chargeability between the carrier and the toner, an amount of the toner which adheres to the carrier and fluidity of the developing agent come to be favorable and supply of the toner to a photoreceptor is stably performed. Accordingly, not only scattering of the toner into the inside of the apparatus is suppressed but also the high image density is obtained and, as a result, the two-component developing agent for electrophotography which is durable even in use for a long period of time can be obtained.

Further, in the invention, it is preferable that titanium oxide has a shape of 0.04 to 0.07 μm width, 0.2 to 0.3 μm length and has a specific surface area of 70 to 90 $m^2/g$; and a surface of the titanium oxide is subjected to a coating treatment by zirconium oxide and aluminum oxide.

Further, according to the invention, since the shape of titanium oxide and the specific surface area are favorable and the frictional chargeability between the carrier and the toner comes to be favorable, it is possible to secure suppression of the scattering of the toner and the high image density. Since the surface of titanium oxide is subjected to the coating treatment by zirconium oxide and aluminum oxide, the resin is prevented from being decomposed by a catalytic action of titanium oxide and, also, titanium oxide particles each having a decreased dispersibility are prevented from being aggregated and, accordingly, the two-component developing agent for electrophotography is excellent in durability.

Further, in the invention, it is preferable that a particle diameter of the carrier is preferably 30 to 100 μm.

Further, according to the invention, since the particle diameter of the carrier is 30 to 100 μm, the chargeability between the toner and the carrier comes to be favorable and, accordingly, the amount of the toner which adheres to the carrier comes to be favorable. As a result, since the toner can stably be supplied to the photoreceptor, a favorable image density can be obtained.

Further, In the invention, it is preferable that the toner preferably has a volume average particle diameter of 5 to 10 μm and a content rate of particles each of which have a diameter of 5 μm or less is preferably 17% by number or less.

Further, according to the invention, since the volume average particle diameter of the toner is as small as 5 to 10 μm and the content rate of unduly small particles each of which have a diameter of 5 μm or less is low, not only scattering of the toner can be suppressed but also it is possible to secure the high image density.

Further, in the invention, it is preferable that the toner contains a coloring agent and the coloring agent is contained in an amount of 4 to 12% by weight in the toner.

Further, according to the invention, since the content rate of the coloring agent in the toner is set to be in a favorable range, the high-quality image can be obtained.

Further, in the invention, it is preferable that the coating layer contains titanium oxide of 10 to 100 parts by weight on the basis of 100 parts by weight of the silicone resin.

Further, in the invention, it is preferable that the coating layer contains titanium oxide of 30 to 60 parts by weight on the basis of 100 parts by weight of the silicone resin.

Further, in the invention, it is preferable that an amount of the silicone resin containing titanium oxide to be coated is, based on 100 parts by weight of the core material, 0.05 to 10 parts by weight.

Further, in the invention, it is preferable that an amount of the silicone resin containing titanium oxide to be coated is, based on 100 parts by weight of the core material, preferably 1 to 5 parts by weight.

Further, in the invention it is preferable that the silicone resin coating layer formed on the surface of the core material is subjected to a baking treatment.

According to the invention, the silicone resin coating layer formed on the surface of the core material can be stabilized by subjecting it to a baking treatment.

DETAILED DESCRIPTION OF THE PREFERRED EMBODIMENT

Now referring to the drawings, preferred embodiment of the invention are described below.

A two-component developing agent for electrophotography according to the invention is such a two-component developing agent as contains a toner and a carrier and is characterized in that the carrier contains a core material and a coating layer to be formed on a surface of the core material and the coating layer is a silicone resin coating layer containing dendritic titanium oxide.

[Carrier]

The carrier is constituted by the core material and the silicone resin coating layer to be formed on the surface of the core material.

(Core Material)

Examples of such core materials include iron powder, magnetite and ferrite. As for the ferrite, a known ferrite can be used; ferrite powder of, for example, copper, nickel, zinc, cobalt and manganese can be used. The core material which is either spherical or amorphous can be used; however, the core material having a higher circularity is preferred.

Further, a particle diameter of the core material is preferably 30 to 100 μm. When the particle diameter is unduly small, that is, less than 30 μm, a specific surface area of the carrier comes to be large, frictional charge comes to be large and, then, a charge amount between the carrier and the toner is increased. As a result, since an adhering force between the carrier and the toner comes to be large and fluidity of the developing agent is deteriorated, the toner cannot stably be supplied to the photoreceptor, to thereby cause a decrease of density. On the other hand, when the particle size is unduly large, that is, over 100 μm, the frictional charge ability between the carrier and the toner is deteriorated and there is a fear in which the toner does not adhere to the carrier. As a result, the toner is not transported by the carrier, to thereby cause a decrease of the image density.

(Coating Layer)

As for the resin of the coating layer, a silicone resin is used. Since the silicone resin has a low surface energy, the frictional charge does not come to be unduly large and an amount of the toner which adheres to the carrier can be set in a favorable range, the silicone resin is effective in enhancing the fluidity of the developing agent. Examples of such silicone resins include an ordinarily-used thermosetting type silicone such as a methyl-based silicone resin, an acrylic-modified silicone resin and an ambient temperature-curing type silicone.

Further, in the silicone resin, dendritictitanium oxide e is allowed to be contained. Titanium oxide is effective in stabilizing the chargeability and imparting fluidity to the developing agent. The term "dendritic" as used herein refers to a shape having at least two branches projected from a cylindrical major axis.

Dendritic titanium oxide having a width of 0.04 to 0.07 μm, a length of 0.2 to 0.3 μm and a BET specific surface area of 70 to 90 $m^2/g$ is used. Further, in order to enhance durability of the silicone resin by suppressing a catalytic action of titanium oxide and, further, in order to prevent titanium oxide which has decreased in dispersibility from being aggregated, a surface of titanium oxide is preferably subjected to a coating treatment with zirconium oxide and aluminum oxide. Titanium oxide thus treated is such titanium dioxide as represented by TTO series manufactured by Ishihara Sangyo Kaisha, Ltd. and, for example, TTO-S-1 and TTO-D-1 are favorably used.

In order to allow titanium oxide to be contained in the silicone resin, for example, the silicone resin is dissolved in a solvent such as ethyl acetate, toluene or xylene and, then, added with titanium oxide in an amount, based on 100 parts by weight of the silicone resin, of 10 to 100 parts by weight, preferably 30 to 60 parts by weight, to thereby allow titanium oxide to be uniformly dispersed in the silicone resin. As for an apparatus to be used on this occasion, a ball mill mixer, a Henschel mixer or the like is mentioned.

(Formation of Coating Layer)

As for a method for forming the coating layer on the surface of the core material, for example, a method in which the core material is dip in such silicone resin coating solution in which titanium oxide is uniformly dispersed as prepared above, coated and, then, dried and another method in which the core material is sprayed with the coating solution, coated and, then, dried are mentioned. As for the apparatus to be used in forming such a coating layer as described above, for example, a rotating coating apparatus or a flow coating apparatus is mentioned. An amount of the silicone resin containing titanium oxide to be coated is, based on 100 parts by weight of the core material, preferably 0.05 to 10 parts by weight and, more preferably, 1 to 5 parts by weight. Further, the silicone resin coating layer formed on the surface of the core material is preferably subjected to a baking treatment to be stabilized.

[Toner]

The toner constituting the two-component developing agent according to the invention contains at least a binder resin and a coloring agent.

(Binder Resin)

As for such binder resins, known resins can be used. Polystyrene, a styrene-acrylic copolymer, a styrene-acrylonitrile copolymer, a styrene-maleic anhydride copolymer, a polyvinyl chloride resin, a polyolefin resin, an epoxy resin, a silicone resin, a polyamide resin, a polyurethane resin, a urethane-modified polyester resin, an acrylic resin and the like can be mentioned. These resins may be used either each individually or in mixing a plurality of types. Further, the copolymer may either be a block copolymer or a graft copolymer. A molecular weight distribution may have one peak or two peaks.

(Coloring Agent)

As for the coloring agent, a known coloring agent may be used. Examples of such coloring agents include carbon black, aniline black, acetylene black, naphthol yellow, Hanza yellow, rhodamine lake, alizarine lake, colcothar, phthalocyanine blue and indanthrene blue.

A content of the coloring agent is, based on the entire weight of the toner, preferably 4 to 12% by weight. When the content is less than 4% by weight, an image having a sufficient image density cannot be obtained. When the content is over 12% by weight, dispersibility of the coloring agent in the binder resin is deteriorated.

(Wax)

In addition to the binder resin and the coloring agent, the toner according to the invention may contain a parting agent such as a wax within a range of not loosing favorable characteristics thereof. As for the wax, a known wax can be used and at least one type of wax selected from among polyethylene, polypropylene, an ethylene-propylene copolymer and a polyolefin can be mentioned. The wax is used, based on 100 parts by weight of the binder resin, preferably in an amount of 2 parts by weight to 8 parts by weight. When the amount is less than 2 parts by weight, an offset tends to be generated, while, when the amount is over 8 parts by weight, filming tends to be generated.

(Charge Control Agent)

In addition to the binder resin and the coloring agent, the toner according to the invention may contain an additive such as a charge control agent within a range of not loosing the favorable characteristics thereof.

As for such charge control agents, an azo type dye, a metal complex of a carboxylic acid, a quaternary ammonium compound, a nigrosine type dye and the like can be mentioned. The charge control agent is used, based on 100 parts by weight of the binder resin, preferably in an amount of 1 part by weight to 3 parts by weight. When the amount is less than 1 part by weight, a sufficient chargeability cannot be imparted, while, when the amount is over 3 parts by weight, it becomes difficult to uniformly disperse the charge control agent in the resin.

(Preparation of Toner)

The toner according to the invention can be obtained such that a coloring agent, a charge control agent, a wax as an anti-offset agent and the like are melt-kneaded to a binder resin, cooled to be solidified, crushed and, then, classified. Further, before kneading, these materials are preliminarily mixed with one another by using a mixing apparatus. The apparatus is not particularly limited and a high-speed stirring type mixing apparatus, for example, a super mixer or a Henschel mixer is mentioned. The resultant pre-mixed material mixture is supplied to a melt-kneading step. In the melt-kneading step, for example, a twin-screw kneader is used. The resultant kneaded article is supplied to a crushing step in which the kneaded article is crushed to be in a desired particle diameter. The crushing apparatus is not particularly limited and, for example, a jet type crushing apparatus such as a swirling-flow type jet mill or a collision-plate type jet mill and a rotation type mechanical mill are mentioned. Subsequently, a classification is performed in order to obtain a desired particle diameter distribution, to thereby obtain toner particles. A classification apparatus is not particularly limited and, for example, an air-blow type classification apparatus, an inertia type classification apparatus and a sieve type classification apparatus are mentioned.

By passing through these steps, the toner in which a volume average particle diameter is 5 to 10 μm and a content of particles whose particle diameter is 5 μm or less is 17% by number or less is obtained.

When the volume average particle diameter is less than 5 μm, or the content of the particles whose particle diameter is 5 μm or less is over 17% by number, the particle diameter of the toner comes to be unduly small and, then, high charging and low fluidization of the developing agent are generated and, since the toner cannot stably be supplied to the photoreceptor, there is a fear of decreasing the image density. Further, when the volume average particle diameter of the toner is over 10 μm, the particle diameter of the toner comes to be large and, then, a high-quality image cannot be obtained and, further, since supply stability of the toner to the photoreceptor is lost due to the resultant lower charge, there is a fear of contaminating the inside of the machine by the scattering of the toner.

Further, the toner obtained in such manner as described above may be mixed with an external additive which bears a function of, for example, improvement of fluidity of the toner, improvement of frictional chargeability, improvement of heat resistance and long-term storability, improvement of cleaning characteristics, a control of abrasion characteristics of the surface of the photoreceptor or the like. As for such external additives, for example, fine particles of inorganic oxides (silicon dioxide, titanium dioxide, magnesium oxide, alumina, silica and the like) and fine particles of resins which have been synthesized by a soap-free emulsion polymerization method are used. An amount of the external additive to be added is, based on 100 parts by weight of the raw material mixture, preferably about 2 parts by weight.

[Production of Two-Component Developing Agent]

The two-component developing agent can be produced by mixing the carrier and the toner which have been obtained in such manners as described above by using a mixer. As for the mixer, a known mixer can be used; for example, a V type mixer or a W type mixer can be mentioned.

EXAMPLE

Hereinafter, embodiments according to the invention will be described; however, the invention is not limited thereto.

In the embodiments, physical properties of a core material of a carrier and a toner were measured in such manners as described below.

[Particle Diameter of Core Material]

A particle diameter of the core material was measured by using a laser particle-size measuring apparatus LA-920 (trade name; manufactured by Horiba, Ltd.).

[Volume Average Particle Diameter and Particle Diameter Distribution of Toner Particle]

Particle diameters of the toner particles were measured by using a Multisizer (manufactured by Coulter Electronics, Inc.) and, from the results, a volume average particle diameter and a particle diameter distribution were determined.

[Production of Two-Component Developing Agent for Electrophotography]

In such a manner as described below, a carrier having a resin coating layer on a surface of a core material and a toner which has been prepared such that a material mixture containing a binder resin, a coloring agent, a wax and a charge control agent was preliminarily mixed, melt-kneaded, crushed and, then, classified were mixed with each other, to thereby produce two-component developing agents for photography in Examples and Comparative Examples.

Example 1

Carrier

Core Material

As for a core material, a Cu—Zn ferrite having a particle diameter of 65 μm was used.

(Coating Layer)

As for a silicone resin of a coating layer, a thermosetting type silicone was used.

As for titanium oxide containing the silicone resin, titanium oxide in a dendritic shape having a width of 0.06 μm, a length of 0.3 μm and a specific surface area of 80 $m^2/g$ (trade name: TTO-D-1; manufactured by Ishihara Sangyo Kaisha, Ltd.) in which a surface was subjected to a coating treatment by zirconium oxide ($ZrO_2$) and aluminum oxide ($Al_2O_3$) was used.

Further, a coating solution prepared by firstly dissolving the silicone resin in 100 parts by weight of toluene on the basis of 100 parts by weight of the silicone resin and, secondly, adding 60 parts by weight of titanium oxide on the basis of 100 parts by weight of the silicone resin and, then, allowing titanium oxide to be uniformly dispersed in the silicone resin was mixed for 12 hours by using, as media, a ball mill containing zirconia balls each of which have a diameter of 3 mm, to thereby finalize a coating solution.

(Formation of Coating Layer)

Subsequently, the core material was subjected to coating by using a flow coating apparatus such that, in a coating amount, the silicone resin containing titanium oxide was allowed to be 5 parts by weight on the basis of 100 parts by weight of the core material, to thereby form a silicone resin coating layer. Thereafter, the silicone resin coating layer was subjected to a baking treatment for 2 hours at 200° C., to thereby prepare a carrier.

[Toner]

A toner was prepared such that a coloring agent, a charge control agent, a wax as an anti-offset agent and the like were melt-kneaded to a binder resin, cooled to be solidified, crushed and, then, classified.

(Binder Resin)

As for a binder resin, a polyester resin (manufactured by Mitsui Kasei Kogyo Inc.) was used in an amount of 100 parts by weight.

(Coloring Agent)

As for a coloring agent, carbon black (trade name: 330R; produced by Cabbot Speciality Chemicals, Inc.) was used in an amount of 7 parts by weight.

(Wax)

As for a wax, polyethylene (trade name: PE 130; manufactured by Clariant (Japan) K.K.) and polypropylene (trade name: NP-505; manufacture by Mitsui Chemicals, Inc.) were used in an amount of 1.0 part by weight and in an amount of 1.5 parts by weight, respectively.

(Charge Control Agent)

As for a charge control agent, T-77 (trade name; manufactured by Hodogaya Chemical Co., Ltd.) and Magnetite (trade name: KBC-100; manufactured by Kanto Denka Kogyo Co., Ltd.) were used in an amount of 1.0 part by weight and in an amount of 1.5 parts by weight, respectively.

(Production of Toner)

Such toner material as described above was fully mixed by using a super mixer (manufactured by Kawada K.K.) and, then, melt-kneaded by using a twin-screw kneader (trade name: PCM-30; manufactured by Ikegai Corporation). The resultant kneaded article was crushed by using a jet type crusher (trade name: IDS-2; manufactured by Nippon Pneumatic Mfg., Co., Ltd.), classified and adjusted in a manner as described below to prepare toner particles in which a volume average particle diameter is 8.5 μm and a content rate of particles each having a particle diameter of 5 μm or less is 16.5% by number.

Further, as for an external additive for the thus-obtained toner particle, silica fine particles (trade name: R972; manufactured by Nippon Aerosil Co., Ltd.) were externally added in an amount, based on 100 parts by weight of the toner particles, of 0.3 part by weight, to thereby prepare the toner.

[Production of Two-Component Developing Agent]

950 g of the thus-prepared carrier and 50 g of the toner were stirred for 15 minutes by using a V type mixer (manufactured by Tokuju Co., Ltd.), to thereby prepare a two-component developing agent in Example 1.

Example 2

A two-component developing agent in Example 2 was prepared in a same manner as in Example 1 except that, in the preparation of the carrier, titanium oxide in the resin coating layer was in an amount of 10 parts by weight on the basis of 100 parts by weight of the silicone resin.

Example 3

A two-component developing agent in Example 3 was prepared in a same manner as in Example 1 except that, in the preparation of the carrier, titanium oxide in the resin coating layer was in an amount of 30 parts by weight on the basis of 100 parts by weight of the silicone resin.

Example 4

A two-component developing agent in Example 4 was prepared in a same manner as in Example 1 except that, in the preparation of the carrier, titanium oxide in the resin coating layer was in an amount of 40 parts by weight on the basis of.

100 parts by weight of the silicone resin.

Example 5

A two-component developing agent in Example 5 was prepared in a same manner as in Example 1 except that, in the preparation of the carrier, titanium oxide in the resin coating layer was in an amount of 50 parts by weight on the basis of 100 parts by weight of the silicone resin.

Example 6

A two-component developing agent in Example 6 was prepared in a same manner as in Example 1 except that, in the preparation of the carrier, titanium oxide in the resin coating layer was in an amount of 100 parts by weight on the basis of 100 parts by weight of the silicone resin.

Example 7

A two-component developing agent in Example 7 was prepared in a same manner as in Example 1 except that, in the preparation of the toner, the coloring agent was used in an amount of 8 parts by weight on the basis of 100 parts by weight of the binder resin and a volume average particle diameter of the toner was 7.5 μm and a content rate of particles each of which have a diameter of 5 μm or less in the toner was 16.8% by number.

Example 8

A two-component developing agent in Example 8 was prepared in a same manner as in Example 1 except that, in the preparation of the toner, the coloring agent was used in an amount of 12 parts by weight on the basis of 100 parts by weight of the binder resin and a volume average particle diameter of the toner was 6.5 μm and a content rate of particles each of which have a diameter of 5 μm or less in the toner was 16.8% by number.

Example 9

A two-component developing agent in Example 9 was prepared in a same manner as in Example 1 except that, as the core material, 930 g of the carrier prepared by using a Cu—Zn ferrite having a particle diameter of 40 μm, 12 parts by weight of the coloring agent on the basis of 100 parts by weight of the binder resin were used and, further, 70 g of the toner in which a volume average particle diameter was 6.5 μm and a content rate of particles each of which have a diameter of 5 μm or less was 16.8% by number was used.

Example 10

A two-component developing agent in Example 10 was prepared in a same manner as in Example 1 except that 960 g of the carrier formed by the core material containing a Cu—Zn ferrite having a particle diameter of 90 μm and the silicone resin coating layer containing titanium oxide having a specific surface area of 75 $m^2/g$ in a dendritic shape having a width of 0.05 μm and a length of 0.25 μm (trade name: TTO-S-1; manufactured by Ishihara Sangyo Kaisha, Ltd.), and 40 g of the toner in which a volume average particle diameter was 8.5 μm and a content rate of particles each of which have a diameter of 5 μm or less was 16.8% by number were used.

Example 11

A two-component developing agent in Example 11 was prepared in a same manner as in Example 10 except that, in the preparation of the toner, the coloring agent was used in an amount of 8 parts by weight on the basis of 100 parts by weight of the binder resin and a volume average particle diameter of the toner was 7.5 μm and a content rate of particles each of which have a diameter of 5 μm or less in the toner was 16.5% by number.

Example 12

A two-component developing agent in Example 12 was prepared in a same manner as in Example 10 except that, in the preparation of the toner, the coloring agent was used in an amount of 12 parts by weight on the basis of 100 parts by weight of the binder resin and a volume average particle diameter of the toner was 6.5 μm and a content rate of particles each of which have a diameter of 5 μm or less in the toner was 16.5% by number.

Comparative Example 1

A two-component developing agent in Comparative Example 1 was prepared in a same manner as in Example 1 except that, in the preparation of the carrier, titanium oxide in the resin coating layer was spherical titanium oxide having a particle diameter of 0.03 μm and a specific surface area of 35 $m^2/g$.

Comparative Example 2

A two-component developing agent in Comparative Example 2 was prepared in a same manner as in Example 2 except that, in the preparation of the carrier, titanium oxide in the resin coating layer was spherical titanium oxide having a particle diameter of 0.03 μm and a specific surface area of 35 $m^2/g$.

Comparative Example 3

A two-component developing agent in Comparative Example 3 was prepared in a same manner as in Example 3 except that, in the preparation of the carrier, titanium oxide in the resin coating layer was spherical titanium oxide having a particle diameter of 0.03 μm and a specific surface area of 35 $m^2/g$.

Comparative Example 4

A two-component developing agent in Comparative Example 4 was prepared in a same manner as in Example 4 except that, in the preparation of the carrier, titanium oxide in the resin coating layer was spherical titanium oxide having a particle diameter of 0.03 μm and a specific surface area of 35 $m^2/g$.

Comparative Example 5

A two-component developing agent in Comparative Example 5 was prepared in a same manner as in Example 6 except that, in the preparation of the carrier, titanium oxide in the resin coating layer was spherical titanium oxide having a particle diameter of 0.03 μm and a specific surface area of 35 $m^2/g$.

Comparative Example 6

A two-component developing agent in Comparative Example 6 was prepared in a same manner as in Example 1 except that, in the preparation of the carrier, titanium oxide was not added in the resin coating layer.

Comparative Example 7

A two-component developing agent in Comparative Example 7 was prepared in a same manner as in Example 7 except that, in the preparation of the carrier, titanium oxide was not added in the resin coating layer.

Comparative Example 8

A two-component developing agent in Comparative Example 8 was prepared in a same manner as in Example 10 except that, in the preparation of the carrier, titanium oxide was not added in the resin coating layer.

Comparative Example 9

A two-component developing agent in Comparative Example 9 was prepared in a same manner as in Example 11 except that, in the preparation of the carrier, titanium oxide was not added in the resin coating layer.

Comparative Example 10

A two-component developing agent in Comparative Example 10 was prepared in a same manner as in Example 12 except that, in the preparation of the carrier, titanium oxide was not added in the resin coating layer.

Shapes and specific surface areas of titanium oxide used in preparation of the two-component developing agents in Examples and Comparative Examples, amounts of titanium oxide to be added on the basis of 100 parts by weight of the silicone resin coating layer, particle diameters of the carriers, particle diameters and particle diameter distributions of the toners, concentrations of coloring agents in the toners and concentrations of the toners in the two-component developing agents are collectively shown in Table 1 (Examples) and Table 2 (Comparative Examples).

TABLE 1

| | Titanium oxide (dendritic) | | | | | Toner | | | |
|---|---|---|---|---|---|---|---|---|---|
| Sample No. | Width (μm) | Length (μm) | Specific surface area ($m^2/g$) | Addition amount (part by weight) | Carrier particle diameter (μm) | Volume average particle diameter (μm) | Content of particles of 5 μm or less (% by number) | Coloring agent concentration in toner (% by weight) | Toner concentration in developing agent (% by weight) |
| Example 1 | 0.06 | 0.3 | 80 | 60 | 65 | 8.5 | 16.5 | 6 | 5 |
| Example 2 | 0.06 | 0.3 | 80 | 10 | 65 | 8.5 | 16.5 | 6 | 5 |
| Example 3 | 0.06 | 0.3 | 80 | 30 | 65 | 8.5 | 16.5 | 6 | 5 |
| Example 4 | 0.06 | 0.3 | 80 | 40 | 65 | 8.5 | 16.5 | 6 | 5 |
| Example 5 | 0.06 | 0.3 | 80 | 50 | 65 | 8.5 | 16.5 | 6 | 5 |
| Example 6 | 0.06 | 0.3 | 80 | 100 | 65 | 8.5 | 16.5 | 6 | 5 |
| Example 7 | 0.06 | 0.3 | 80 | 60 | 65 | 7.5 | 16.8 | 7 | 5 |
| Example 8 | 0.06 | 0.3 | 80 | 60 | 65 | 6.5 | 16.8 | 10 | 5 |
| Example 9 | 0.06 | 0.3 | 80 | 60 | 40 | 6.5 | 16.8 | 10 | 7 |
| Example 10 | 0.05 | 0.25 | 75 | 60 | 90 | 8.5 | 16.8 | 6 | 4 |

TABLE 1-continued

| Sample No. | Titanium oxide (dendritic) Width (μm) | Length (μm) | Specific surface area ($m^2/g$) | Addition amount (part by weight) | Carrier particle diameter (μm) | Toner Volume average particle diameter (μm) | Content of particles of 5 μm or less (% by number) | Coloring agent concentration in toner (% by weight) | Toner concentration in developing agent (% by weight) |
|---|---|---|---|---|---|---|---|---|---|
| Example 11 | 0.05 | 0.25 | 75 | 60 | 90 | 7.5 | 16.5 | 7 | 4 |
| Example 12 | 0.05 | 0.25 | 75 | 60 | 90 | 6.5 | 16.5 | 10 | 4 |

TABLE 2

| Sample No. | Titanium oxide Shape | Particle diameter (μm) | Specific surface area ($m^2/g$) | Addition amount (part by weight) | Carrier particle diameter (μm) | Toner Volume average particle diameter (μm) | Content of particles of 5 μm or less (% by number) | Coloring agent concentration in toner (% by weight) | Toner concentration in developing agent (% by weight) |
|---|---|---|---|---|---|---|---|---|---|
| Comp. Ex. 1 | Spherical | 0.03 | 35 | 60 | 65 | 8.5 | 16.5 | 6 | 5 |
| Comp. Ex. 2 | Spherical | 0.03 | 35 | 10 | 65 | 8.5 | 16.5 | 6 | 5 |
| Comp. Ex. 3 | Spherical | 0.03 | 35 | 30 | 65 | 8.5 | 16.5 | 6 | 5 |
| Comp. Ex. 4 | Spherical | 0.03 | 35 | 40 | 65 | 8.5 | 16.5 | 6 | 5 |
| Comp. Ex. 5 | Spherical | 0.03 | 35 | 100 | 65 | 8.5 | 16.5 | 6 | 5 |
| Comp. Ex. 6 | Not added | | | | 65 | 8.5 | 16.5 | 6 | 5 |
| Comp. Ex. 7 | Not added | | | | 65 | 7.5 | 16.8 | 7 | 5 |
| Comp. Ex. 8 | Not added | | | | 90 | 8.5 | 16.8 | 6 | 4 |
| Comp. Ex. 9 | Not added | | | | 90 | 7.5 | 16.5 | 7 | 4 |
| Comp. Ex. 10 | Not added | | | | 90 | 6.5 | 16.5 | 10 | 4 |

In regard to the two-component developing agents in Examples 1 to 12 and Comparative Examples 1 to 10, image densities and toner scattering levels were evaluated. Evaluation methods and evaluation references are described below.

[Image Density Evaluation]

An image density at an initial stage of printing by using each two-component developing agent and another image density after 100,000 copies of an original document having a print ratio of 5% were made by printing with an interval of every 5 sheets were measured by using a Macbeth reflectodensitometer (trade name: RD-914; manufactured by Macbeth Co., Ltd.). For printing, a commercially available black-and-white copying machine AR-450 (trade name; manufactured by Sharp Corporation) was used. Evaluations were performed in accordance with the following criteria:

Image density is 1.33 or more: Excellent;

Image density is 1.30 to less than 1.33: Good; and

Image density is less than 1.30: Bad.

[Evaluation of Toner Scattering Level]

After 500 copies of an original document having a print ratio of 5% were made by using each two-component developing agent in a high-temperature high-moisture environment of a temperature of 35° C. and a moisture of 85%, toners scattered inside a copying machine were collected by suction from an area of 50 mm×50 mm therein. Evaluations were performed in accordance with the following criteria:

Scattered toners thus suction-collected are less than 5 mg: Excellent;

Scattered toners thus suction-collected are 5 mg to less than 10 mg: Good; and

Scattered toners thus suction-collected are 10 mg or more: Bad. Further, copying was performed by using a black-and-white copying machine AR-450 (trade name; manufactured by Sharp Corporation).

Further, evaluation results of the initial image density, the image density after making 100,000 copies by printing, and the toner scattering level were summed up and an evaluation of the performance of each developing agent was performed. A comprehensive evaluation was performed in accordance with the following evaluation criteria:

Excellent: excellent, in which there are all excellent evaluations (Excellent) in evaluation items;

Good: practically no problem, in which there is no unfavorable evaluation (Bad) and at least one favorable evaluation (Good) in evaluation items; and Bad: practically unusable, in which there is at least one unfavorable evaluation (Bad) in evaluation items.

These results are shown in Table 3.

TABLE 3

| Sample No. | Initial image density | Image density after printing of 100000 sheets | Toner scattering amount | Comprehensive evaluation |
|---|---|---|---|---|
| Example 1 | Excellent | Excellent | Excellent | Excellent |
| Example 2 | Good | Good | Good | Good |
| Example 3 | Good | Good | Good | Good |
| Example 4 | Excellent | Excellent | Good | Good |
| Example 5 | Excellent | Excellent | Good | Good |
| Example 6 | Good | Good | Good | Good |
| Example 7 | Excellent | Excellent | Excellent | Excellent |
| Example 8 | Excellent | Excellent | Good | Good |
| Example 9 | Excellent | Excellent | Excellent | Excellent |
| Example 10 | Excellent | Excellent | Good | Good |
| Example 11 | Excellent | Excellent | Good | Good |
| Example 12 | Excellent | Excellent | Good | Good |

TABLE 3-continued

| Sample No. | Initial image density | Image density after printing of 100000 sheets | Toner scattering amount | Comprehensive evaluation |
|---|---|---|---|---|
| Comp. Ex. 1 | Good | Bad | Good | Bad |
| Comp. Ex. 2 | Bad | Bad | Bad | Bad |
| Comp. Ex. 3 | Bad | Bad | Bad | Bad |
| Comp. Ex. 4 | Bad | Bad | Bad | Bad |
| Comp. Ex. 5 | Bad | Bad | Bad | Bad |
| Comp. Ex. 6 | Bad | Bad | Bad | Bad |
| Comp. Ex. 7 | Good | Good | Bad | Bad |
| Comp. Ex. 8 | Good | Good | Bad | Bad |
| Comp. Ex. 9 | Good | Good | Bad | Bad |
| Comp. Ex. 10 | Good | Good | Bad | Bad |

Each of the two-component developing agents according to Examples 1 to 12 of the invention has small amount of the toner scattering and was able to obtain a sufficient image density. Further, it is found that such a two-component developing agent as described above is an excellent developing agent which not only maintains a high image quality without deteriorating the image density even in use for a long period of time but also has the durability required for the developing agent.

On the other hand, each of the two-component developing agents according to Comparative Examples was evaluated as being unfavorable (Bad) in any one or both of the image density and the toner scattering amount and, therefore, was practically unusable.

The invention may be embodied in other specific forms without departing from the spirit or essential characteristics thereof. The embodiment are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A two-component developing agent for electrophotography, comprising:

a toner; and a carrier, the carrier containing a core material and a coating layer formed on a surface thereof, and the coating layer being a silicone resin coating layer containing dendritic titanium oxide, wherein an amount of the silicone resin containing titanium oxide to be coated is, based on 100 parts by weight of the core material, 1 to 5 parts by weight, the coating layer contains titanium oxide of 40 to 60 parts by weight on the basis of 100 parts by weight of the silicone resin, said titanium oxide having a shape of 0.04 to 0.07 μm width, 0.2 to 0.3 μm length and has a specific surface area of 70 to 90 $m^2/g$; and a surface of the titanium oxide is subjected to a coating treatment by zirconium oxide and aluminum oxide.

2. The two-component developing agent for electrophotography of claim 1, wherein a particle diameter of the carrier is 30 to 100 μm.

3. The two-component developing agent for electrophotography of claim 1, wherein the toner has a volume average particle diameter of 5 to 10 μm and the amount of a content rate of particles each of which have a diameter of 5 μm or less is 17% or less.

4. The two-component developing agent for electrophotography of claim 1, wherein the toner contains a coloring agent and the coloring agent is contained in an amount of 4 to 12% by weight in the toner.

5. The two-component developing agent for electrophotography of claim 1, wherein the silicone resin coating layer formed on the surface of the core material is subjected to a baking treatment.

* * * * *